United States Patent [19]

Bailey

[11] 4,200,072

[45] Apr. 29, 1980

[54] FUEL INJECTION PUMP

[75] Inventor: John M. Bailey, Peoria, Ill.

[73] Assignee: Caterpillar Tractor Co., Peoria, Ill.

[21] Appl. No.: 923,171

[22] Filed: Jul. 11, 1978

Related U.S. Application Data

[63] Continuation-in-part of Ser. No. 798,053, May 18, 1977, Pat. No. 4,108,130.

[51] Int. Cl.[2] ..... F02M 41/06

[52] U.S. Cl. ..... 123/139 AP; 123/139 BC; 123/139 AL; 123/139 AQ; 417/294; 417/462

[58] Field of Search ..... 123/139 AP, 139 BC, 123/193 BD, 139 AQ, 139 AL, 140 FG; 417/294, 462

[56] References Cited

U.S. PATENT DOCUMENTS

| | | | |
|---|---|---|---|
| 2,674,236 | 4/1954 | Humber | 123/139 R |
| 2,743,594 | 5/1956 | Hill et al. | 123/139 AQ |
| 3,091,231 | 5/1963 | Giraudon | 123/139 BC |
| 3,138,112 | 6/1964 | Porta et al. | 123/140 R |
| 3,181,520 | 5/1965 | Mock | 123/139 AL |
| 3,319,568 | 5/1967 | Repko et al. | 123/140 FG |
| 3,726,263 | 4/1973 | Kemp | 123/139 BD |
| 3,771,506 | 11/1973 | Davis | 123/139 AQ |
| 4,085,722 | 4/1978 | Bailey | 123/139 AP |
| 4,108,130 | 8/1978 | Bailey | 123/139 AQ |

*Primary Examiner*—Charles J. Myhre
*Assistant Examiner*—Andrew M. Dolinar
*Attorney, Agent, or Firm*—John W. Grant

[57] ABSTRACT

A rotary distributor fuel pump for an engine is provided with a piston driven by an eccentric bore of a rotating assembly for pressurizing fuel communicated thereto. A rotor is provided for varying both volumetric flow as well as timing of fuel injected to the engine. The rotor is rotated at a speed proportional to the rotational speed of the rotating assembly. Volumetric flow is achieved by a change in the axial position of the rotor. Control of timing can be achieved by changing the rotative position of the rotor relative to the rotating assembly.

26 Claims, 12 Drawing Figures

FUEL INJECTION PUMP

CROSS REFERENCES TO RELATED APPLICATIONS

This is a continuation-in-part Application of Ser. No. 798,053 now U.S. Pat. No. 4,108,130 filed May 18, 1977 by John M. Bailey.

BACKGROUND OF THE INVENTION

This invention relates to a distributor type fuel injection pump having in one embodiment opposed reciprocating plungers mounted in a housing to provide pressurized fluid to a rotor which in turn provides fuel metering, distribution, and timing of the fuel delivery to an internal combustion engine.

This invention is particularly directed toward a distributor fuel injection pump which is capable of a high fueling capacity in a small overall size for use on large internal combustion engines particularly the compression ignition type engines. Previous pumps utilized on large engines such as this have required separate injection pumps for each cylinder or a very large distributor pump. Although this pump is designed with a high capacity for large engines, it is easily adaptable to smaller engines by changing the porting structure and internal passage size without a major redesign of the fuel pump.

Fuel pumps in the past of the types described have utilized reciprocating plungers but have had rather complex camming surfaces. Such complex camming surfaces and cam slippers have limited the quantity and pressure of fuel injected because of excessive cam stress. This has tended to restrict the use of distributor pumps to relatively small engines.

Particular problems associated with all fuel injection pumps of the type described herein include a requirement for a relatively high pressure to be communicated to the engine cylinder for ignition therein by compression. Fuel must be communicated to the engine cylinder at a particular time in order to achieve optimum performance of the engine. Fuel also must be delivered to the engine in correct quantity as dictated by the power required to maintain a desired operating speed. Amounts of fuel communicated to the engine obviously must vary according to the engine load. Thus, a distributor type fuel injection pump must serve initially to pressurize the fuel, and secondly to meter the fuel as required. It is also appropriate to vary the injection timing in proportion to engine speed.

SUMMARY OF THE INVENTION

The present invention is directed to overcoming one or more of the problems as set forth above.

In one aspect of the present invention, a distributor fuel pump assembly for an engine includes a housing having a first end portion, a second end portion, a first bore extending longitudinally through said first end portion defining a longitudinal axis, a second bore extending through said second end portion, a third bore coaxial with said first bore, and a plurality of outlet ports in communication with said second bore. A first rotating assembly is journaled for rotation in said third bore and has a shaft rotatably extending outwardly through said first bore and an inner eccentric bore proximate said second end portion. A second rotating assembly is rotatably and slidably positioned in said second bore. A pump means in said second end portion increases the pressure of fuel communicated thereto and includes a bore in said second end portion, a piston slidably positioned in said bore defining a fluid chamber at an inner end of said piston and a slipper element positioned between said piston and said inner eccentric bore. A first means rotates said second rotating assembly in response to rotation of said first rotating assembly and at a speed proportional to the rotational speed of said first rotating assembly. A second means alternately establishes and blocks communication between a source of fuel and said fluid chamber in response to rotation of said rotating assembly. A third means periodically directs fluid from said fluid chamber to each of said outlet ports in a predetermined sequence in response to rotation of said second rotating assembly. A fourth means moves said second rotating assembly axially in said second bore for varying the volumetric flow of fuel directed from said fluid chamber to each of said ports.

BRIEF DESCRIPTION OF THE DRAWINGS

FIG. 9 is a diagrammatic sectional view taken along line IX—IX of FIG. 8 and illustrating at lines VIII—VIII the cutting plane along which FIG. 8 is taken.

DETAILED DESCRIPTION OF THE PREFERRED EMBODIMENT

Figure 1:
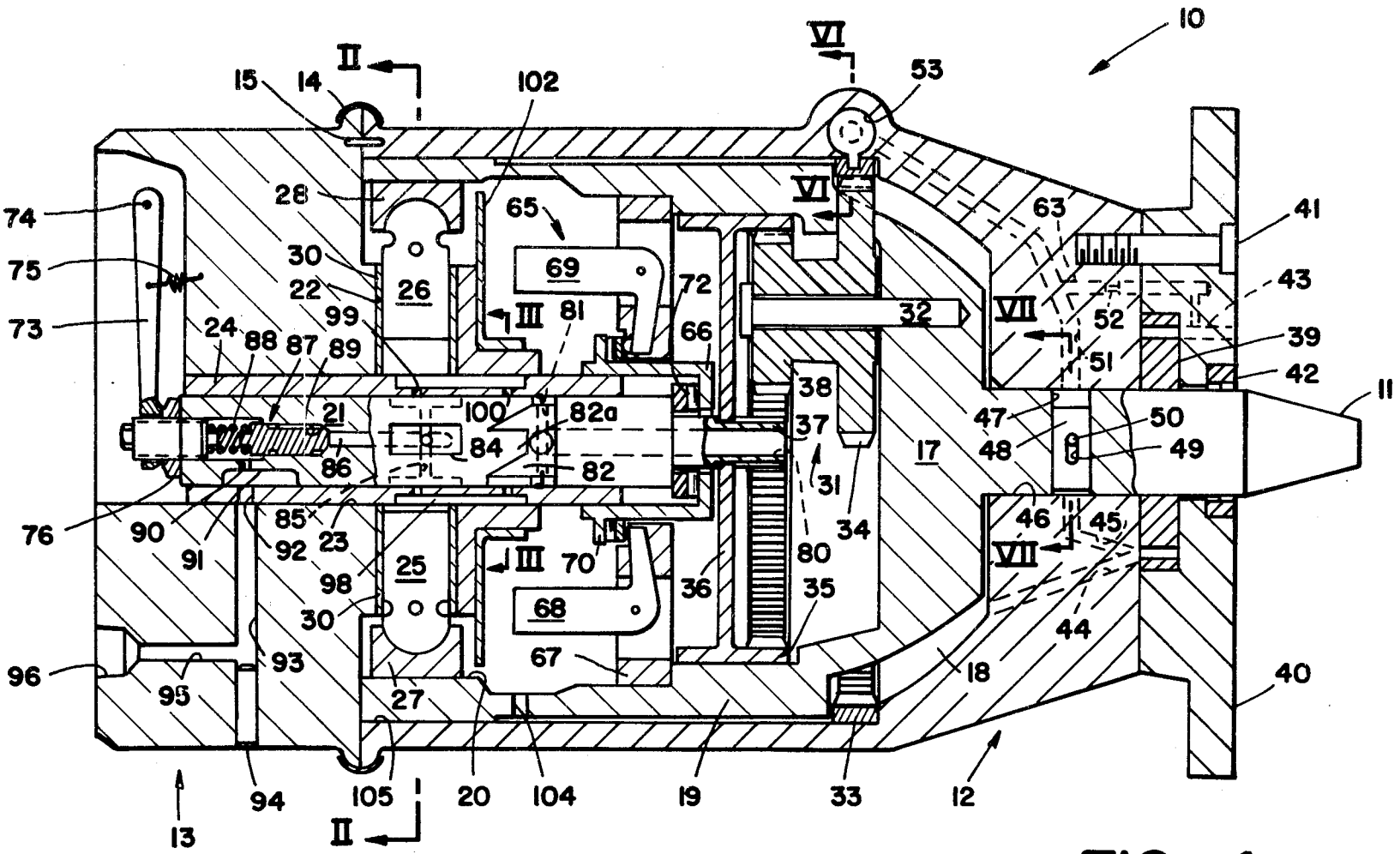
FIG. 1 is an elevation view in section of the distributor type fuel pump which incorporates the inventive concept.

Referring to FIG. 1, an engine fuel pump 10 is shown partly in section. Engine fuel pump 10 is capable of being driven through a shaft 11, extending outwardly of the fuel pump housing which is comprised of a first portion 12 and a second portion 13 affixed to the first portion 12 by means well known in the art, such as a clamp 14. Aligning pins 15 (only one of which is shown in FIG. 1) may be used to ensure alignment of the second portion 13 with first portion 12 upon assembly.

Shaft 11 forms a portion of a first rotating assembly 17 which is journaled in an interior cavity 18 of the first portion 12. First rotating assembly 17 defines a cylindrical extension 19 which in its outer extremity defines an eccentric inner bore 20 the purpose of which will become apparent in the following discussion.

Journaled in the second portion 13 is a second rotating assembly in the form of a metering rotor 21. Metering rotor 21 extends inwardly of cavity 18 and eccentric bore 20. Interposed between metering rotor 21 and eccentric bore 20 is an extension of second portion 13 defining a transverse bore 22 which intercepts an axial bore 23 in second portion 13. Axial bore 23 has fitted therein a sleeve member 24 in which metering rotor 21 is both rotatably and reciprocally movable. Transverse bore 22 is fitted with liners 30 reciprocally mounting opposed piston member 25,26 each of which are fitted into a slipper 27,28, respectively. Resilient means which may be in the form of a C-shaped spring 29 (see FIG. 2) is formed to engage piston members 25,26 adjacent the slippers 27,28 to urge piston members 25,26 outwardly in transverse bore 22 so that slippers 27,28 engage the eccentric bore 20. Therefore, upon rotation of eccentric bore 20, piston members 25,26 are reciprocated in bore 22.

Metering rotor 21 is driven by an epicyclic gear train which in turn is driven by shaft 11 of first portion 17. The epicyclic gear train driving metering rotor 21 is comprised of a cluster of planet gears 31 (one cluster is shown in FIG. 1). Cluster 31 is driven by a carrier pin 32 extending outwardly of first rotating assembly 17 into the cylindrical inner portion thereof. A ring gear 33 is fixedly associated with first portion 12 and is in engagement with each gear 34 of planet gear clusters 31. A second ring gear 35 which serves as the sun gear is formed with a flange 36 splined to an extension 37 of metering rotor 21. A second gear 38 of planet gear cluster 31 is in driving engagement with ring gear 35. The gearing ratio between shaft 11 and metering rotor 21 may be adapted so that metering rotor 21 rotates at one-fourth the speed of rotation of shaft 11. Shaft 11 may be rotated at twice normal engine speed, thus metering rotor 21 will operate at one-half engine speed.

The engine fuel pump 10 is provided with a fuel pressurization means in the form of a conventional gear pump 39 driven by shaft 11. Gear pump 39 is positioned in a flange 40 which is affixed to first portion 12 by conventional means such as bolts 41 (one of which is shown in FIG. 1). Flange 40 is adapted to be received on a conventional mounting pad on the associated internal combustion engine. Flange 40 is also fitted with a seal 42 of a conventional type well known in the art to prevent fuel leakage from the pump 39. Passage means such as passage 43 are formed in flange 40 to communicate fluid to gear pump 39 from a fluid source such as a fuel tank (not shown).

Figure 7:
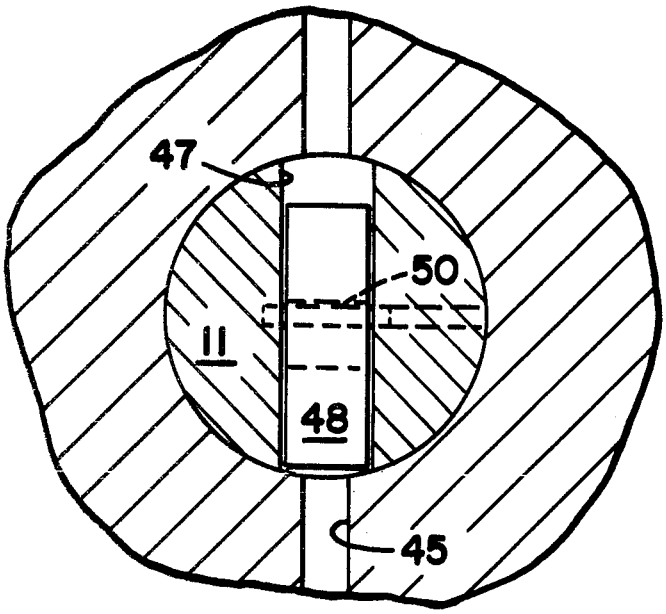
FIG. 7 is a portion of the fuel pump depicted in FIG. 1 showing the shuttle piston taken at lines VII—VII.

First portion 12 defines therein an internal passage 44 extending from gear pump 39 to the interior cavity 18. Thus, fluid pressurized by gear pump 39 is communicated through passage 44 to interior cavity 18 wherein a pressure is maintained equivalent to the output pressure controlled by a relief valve (not shown) of gear pump 39. A branching passage 45 communicates with passage 44 to communicate pressurized fluid to a bore 46 formed in first portion 12 through which shaft 11 extends and is journaled. Bore 46 forms an appropriate bearing surface for shaft 11. Shaft 11 is formed with a transverse bore 47 forming a cylinder. Mounted in transverse bore 47 is a shuttle piston 48. Referring to FIG. 7 in conjunction with FIG. 1 it can be seen that shuttle piston 48 is formed with a slot 49 through which a pin 50 extends. Slot 49 is formed to allow shuttle piston 48 to reciprocate a predetermined amount in the transverse bore 47.

Figure 6:
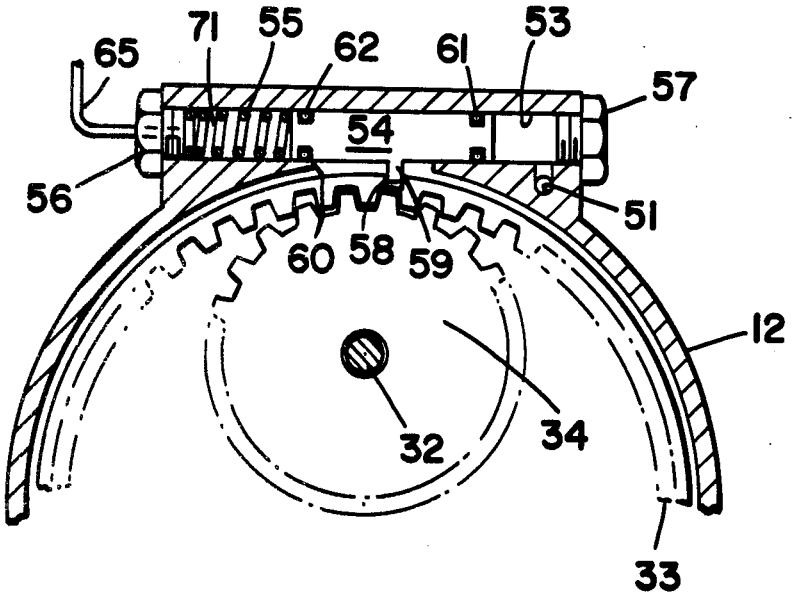
FIG. 6 is a portion of the fuel pump depicted in FIG. 1 taken at section line VI—VI, depicting the timing advance portion.

Also communicating with bore 46 and on the diametrically opposite side of bore 46 from passage 45 is a second passage 51 defined in first portion 12 and which communicates with a transverse bore 53 generally parallel to the plane of ring gear 33 and formed in first portion 12 in the vicinity of ring gear 33 (see FIG. 6). A branch passage 63 containing a restrictive orifice 52 from passage 51 directs fuel oil back to gear pump 39 inlet. Bore 53 has mounted for reciprocation therein a piston 54 reciprocally biased toward the one end of bore 53 which communicates with passage 51. The resilient biasing may be accomplished by a helical spring 55 retained in bore 53 and by the cover member 56. A vent passage 65 is provided from spring cavity 71 to transfer pump inlet to prevent a pressure block behind piston 54. For completeness sake, the other opposite end of bore 53 adjacent passage 51 may similarly be closed by a cover member 57. Other appropriate sealing means may be effectively utilized. Ring gear 33 which is of a conventional type, also includes on its outer perimeter thereof a socket 58 formed to receive a tang 59 integrally formed with piston 54. Bore 53 is purposely opened at 60 to allow tang 59 to extend downwardly and engage socket 58 as seen in FIG. 6. With the opening 60 formed in housing 12, it may be necessary to include appropriate seal means such as seal rings 61,62 to seal piston 54 in bore 53. The specific purpose of piston 54 will become apparent in the discussion of the operation of the fuel pump, suffice it to say at this time the purpose of piston 54 is to vary the relative position between the first rotating assembly 17 and the metering rotor 21.

Shaft 11 attached to flyweight carrier 67 drives a governor 65 which serves to move metering rotor 21 axially as shown in FIG. 1 in response to changes in engine speed as a result of change in engine load or in response to changes in throttle positions. A flyweight carrier 67 is fixed and driven by rotating assembly 17 and has mounted therein governor flyweights such as flyweights 68,69 formed in the usual manner. Weights 68,69 engage a flange assembly 70 formed in part by cup-shaped member 66. Thus, increase in rotational speed of the governor assembly 65 causes the weight 68,69 to swing outwardly by centrifugal force deflecting governor control spring 75 and urge the flange assembly and cup-shaped member 66 leftwardly as shown in FIG. 1. A bearing such as needle bearing 72 is interposed between rotor 21 and the governor assembly 65.

Affixed to the other opposite end of metering rotor 21 is a governor control lever 73 which may be affixed to second portion 13 by a pin 74 and engaging metering rotor 21 at the other opposite end of the lever. A governor control spring 75 may urge lever 73 in a counterclockwise direction as shown in FIG. 1 thus urging metering rotor 21 inwardly of first portion 13. Appropriate thrust bearings 76 which may be in the form of needle bearings allow free rotation of metering rotor 21 in relation to governor control lever 73. It should be apparent to those skilled in the art that other means may be employed to control the axial movement of metering rotor 21. These means could include solenoids, hydraulic pistons, or the like. Such means could also replace the governor assembly 65. Furthermore, with the depicted embodiment, governor control lever 73 may be associated with a throttle control linkage (not shown) to provide varying operating conditions.

Metering rotor 21 is formed with an axial bore 80 which communicates with interior cavity 18 of first portion 12. Axial bore 80 is intersected by a plurality of radially extending bores 81 (see FIG. 3). Each radially extending bore 81 communicates with a machined relieved portion 82 which is adjacent to scrolls or lands 82A formed on the periphery of metering rotor 21. As can be seen in FIG. 1, the machined scrolls 82A are formed with one side parallel to the axis of metering rotor 21, a second side perpendicular to the axis, and a third side connecting the second side with the first side of the adjacent scroll thus forming generally a truncated triangle when observed in cross section. The purpose of this shape will become apparent in the following discussion. Choice of the aforedescribed speed of rotation of the metering rotor 21 permits the use of four scrolls 82A. Such a combination makes the metering rotor adaptable to all engines having a number of cylinders formed by a multiple of four. This will become apparent in the discussion of an alternate embodiment.

Axially displaced from machined scrolls 82A and in a direction toward the governor lever 73 are a plurality of slots 84 formed in the periphery of rotor 21 each angularly displaced generally 45° from the previously described machined relieved portions 82. Communicating with each slot 84 is a radial bore 85 extending inwardly to intersect an axial bore 86 extending toward the governor control lever 73. Disposed in bore 86 distal to slots 84 is a delivery valve 87 which is resiliently biased to the closed position by resilient means such as helical spring 88. Delivery valve 87 is formed with a conical end 89 adapted to be seated in a similar conical shaped seat in bore 86. Extending outwardly from delivery valve 87 is a radial bore 90 intersecting an elongated slot 91 formed in metering rotor 21. Elongated slot 91 communicates with one of a plurality of ports 96 adapted for connection to a plurality of engine cylinders. For convenience sake one such port means is illustrated in FIG. 1 and includes a bore 92 through sleeve member 24 communicating with a bore 93 in second portion 13 which is plugged by a plug 94 and intersected by a second bore 95 which terminates in an appropriate port 96 in second portion 13. It is to be understood that there will be a number of ports 96 equal to the number of cylinders for which the distributor type fuel injection pump has been formed. As noted, only one such port 96 is shown in this embodiment. Ports 96 are connected by appropriate fuel lines, not shown, with injectors at each engine cylinder.

Figure 2:
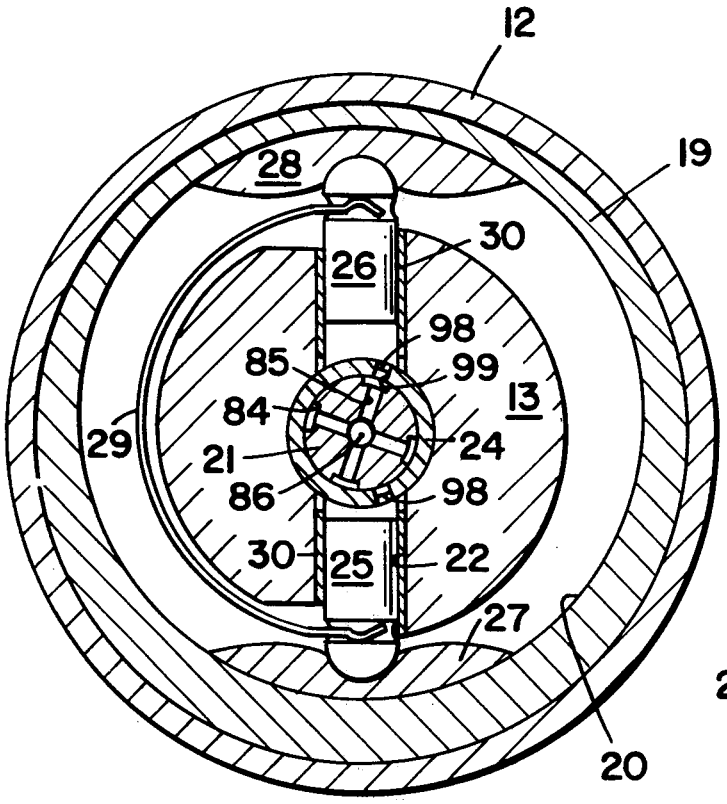
FIG. 2 is a sectional view of a portion of the fuel pump shown in FIG. 1 taken at section line II—II.
Figure 3:
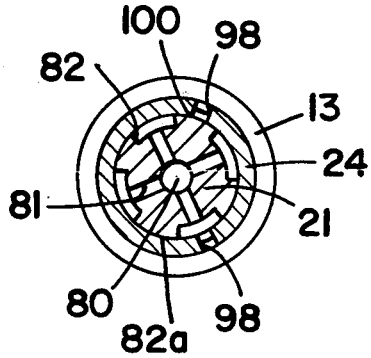
FIG. 3 is a sectional view of the fuel pump illustrated in FIG. 1 taken at section line III—III.

Sleeve member 24 is formed with slots 98 in the vicinity of piston members 25,26 and extending rightwardly as shown in FIG. 1 toward governor assembly 65. Reference should be made at this point to FIGS. 2 and 3 to show the angular orientation of the two slots 98 adapted for use in an eight cylinder engine. It is pointed out that the slots 98 just described appear in FIG. 1 to be diametrically opposed. This is for convenience in illustration only and references to FIGS. 2 and 3 show a more representative relationship between the slots. Extending inwardly from slot 98 for communication with slot 84 is a radial bore 99. It should be pointed out at this time that sleeve 24 is fixedly associated with second portion 13. Thus the slots 84 will come into and pass out of communication with radial bore 99 as the metering rotor rotates. A second bore 100 extends inwardly from slot 98 in the vicinity of machined relieved portion 82 to communicate with machined relieved portion 82 and to be blocked by scroll 82A (see FIG. 3).

Several constructional details of the pump which facilitate operation thereof are described hereafter. In view of the fact that interior cavity 18 is pressurized with fluid, the governor member 68,69 can create a sufficient amount of disturbance in the fuel chamber to interfere with the operation of piston members 25,26. Accordingly, a baffle plate 102 is included within the housing to generally separate the interior cavity 18 and in particular the cavity in which the flyweights 68,69 rotate relative the piston members 25,26. Further, a bore 104 is formed in the perimeter of cylindrical extension 19 to allow free communication of fluid inwardly and outwardly from this previously described interior cavity containing the flyweights to cavity 18. It should be noted that cylindrical extension 19 is formed with an enlarged extremity in the vicinity of eccentric bore 20. This enlarged extremity forms the bearing surface 105 which in addition to a similar bearing surface formed in bore 46 rotatably supports the first rotating assembly 17.

Operation of the Preferred Embodiment

In operation the distributor type fuel injection pump 10 is driven by shaft 11 interconnected with a prime mover (not shown) for which fuel is to be provided. Fuel is communicated to the integrally formed gear pump 39 of the fuel injection pump wherein it is pressurized for communication to interior cavity 18 and simultaneous communication through the shuttle piston 48 to bore 53 to act on piston 54 and influence timing of the distributor type fuel pump. Planet gear cluster 31 driven by the first rotating assembly 17 in turn drives metering rotor 21. As previously mentioned, shaft 11 which is integrally formed with first rotating assembly 17 may be driven at twice engine speed while the planet gear cluster 31 may reduce the speed of metering rotor 21 to one-half engine speed. Other gear ratios may be appropriate for special configurations. Rotation of the first rotating assembly 17 causes reciprocation of pistons 25,26 in their respective bores. Fluid communicated through axial bore 80 flows outwardly through radially extending bores 81 and is periodically communicated to slot 98 as shown in FIG. 3. Fluid communicated to slot 98 is further communicated to piston 25 as shown in FIG. 2. Such fluid, of course, will flow into the cylinder as piston member 25 is urged outwardly against the rotating eccentric bore 20 by C-shaped spring 29. As eccentric bore 20 is urging the other piston 26 inwardly fluid is further pressurized to be exhausted at a higher pressure through slot 98, radial bore 99, and slot 84 when metering rotor 21 registers with radial bore 99. At this time the same slot 98 is blocked from communication with bore 80 by scoll 82A. The resulting increased pressure in axial bore 86 causes the delivery valve 87 to unseat, allowing communication through the valve to elongated slot 91 which communicates with one of the plurality of bores 92 formed in sleeve 24 and hence to passages 93,95 to engine cylinders. Fluid is communicated to the cylinder in which piston member 25 is reciprocating as long as machined relieved portion 82 is in communication with the radially extending bore 100 in sleeve 24. Similarly, fluid will be communicated outwardly of the cylinder in which piston 25 or 26 reciprocates as long as slot 84 is in communication with bore 99 and scroll 82A blocks bore 100.

As engine speed increases, flyweights 68,69 are urged outwardly thus urging metering rotor 21 leftwardly as shown in FIG. 1. Such axial displacement decreases the time bore 100 is blocked by scroll 82A. This results in less fuel being communicated to the engine cylinders thus decreasing engine speed.

It is well known that as engine speed increases better efficiency is obtained if timing of the injection of fuel is also varied. This is accomplished in this distributor type fuel injection pump by rotation of the ring gear 33 relative to first portion 12 through the use of the tang 59 formed on piston 54. As engine speed increases, the rotation of shaft 11 increases, causing shuttle piston 48 to reciprocate at a higher frequency. Since shuttle piston 48 has a fixed axial travel, the result is a flow through passage 51 which is proportional to speed. The flow passing through passage 51 and passage 63 containing orifice 52 results in pressure which increases with speed and this pressure communicates through bore 53 to act on piston 54. The increased pressure in bore 53 moves piston 54 leftwardly as indicated in FIG. 6 thus rotating ring gear 33. This rotation of ring gear 33 varies the timing of the entire engine fuel pump 10 as a function of the speed of rotation of the input shaft 11. Other means for rotation of gear 33 may also be employed such as an electronic servo system.

Alternate Embodiments

Figure 4:
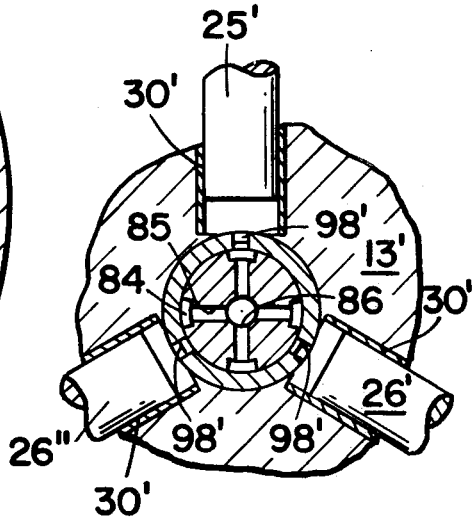
FIG. 4 is an alternate embodiment of the piston arrangement depicted in FIG. 2, particularly adapted for a multicylinder engine of 6 or 12 cylinders.
Figure 5:
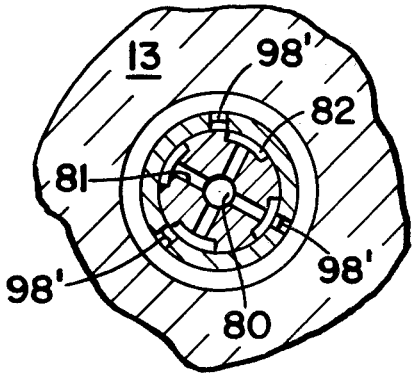
FIG. 5 is a view taken at section III—III of the embodiment shown in FIG. 4.

Illustrated in FIGS. 4 and 5 is an embodiment particularly configured for use in a 12-cylinder engine. The remaining parts of the engine fuel pump for use with the arrangement shown in FIGS. 4 and 5 are as previously illustrated. It should be noted that FIG. 4 corresponds to FIG. 2, that is, a section taken at line II—II of FIG. 1 while FIG. 5 corresponds to FIG. 3 of the preferred embodiment. It can be seen in FIG. 4 that the number of slots 98' has been increased to three. This relationship is repeated in FIG. 5. Similarly, the number of pistons corresponding to piston 25,26 has been increased to three.

It should be apparent to those skilled in the art that the embodiment depicted in FIGS. 4 and 5 can be readily adapted to a six cylinder four stroke engine by eliminating two of the slots 84 and two of the slots 82, ensuring that the remaining slots 84 and slots 82 are each 180° apart.

A four cylinder engine may also utilize the same distributor fuel injection pump as described in the preferred embodiment by disabling one of the pistons 25 or 26. This disablement of the piston member may be accomplished by drilling the piston member axially, thus allowing fluid trapped in the cylinder to pass outwardly into inner interior cavity 18. Simultaneously, the associated port 98 should be plugged.

It is important to note that pressure necessary to move ring gear 33 to adjust timing and pressures necessary to axially move rotor 21 are minimal as the high pressures are generally confined to the reciprocating piston/slipper arrangement. With such relatively low pressures in the control elements, means other than those described are equally appropriate for axial adjustment or angular adjustment of rotor 21.

Second Embodiment

Figure 8:
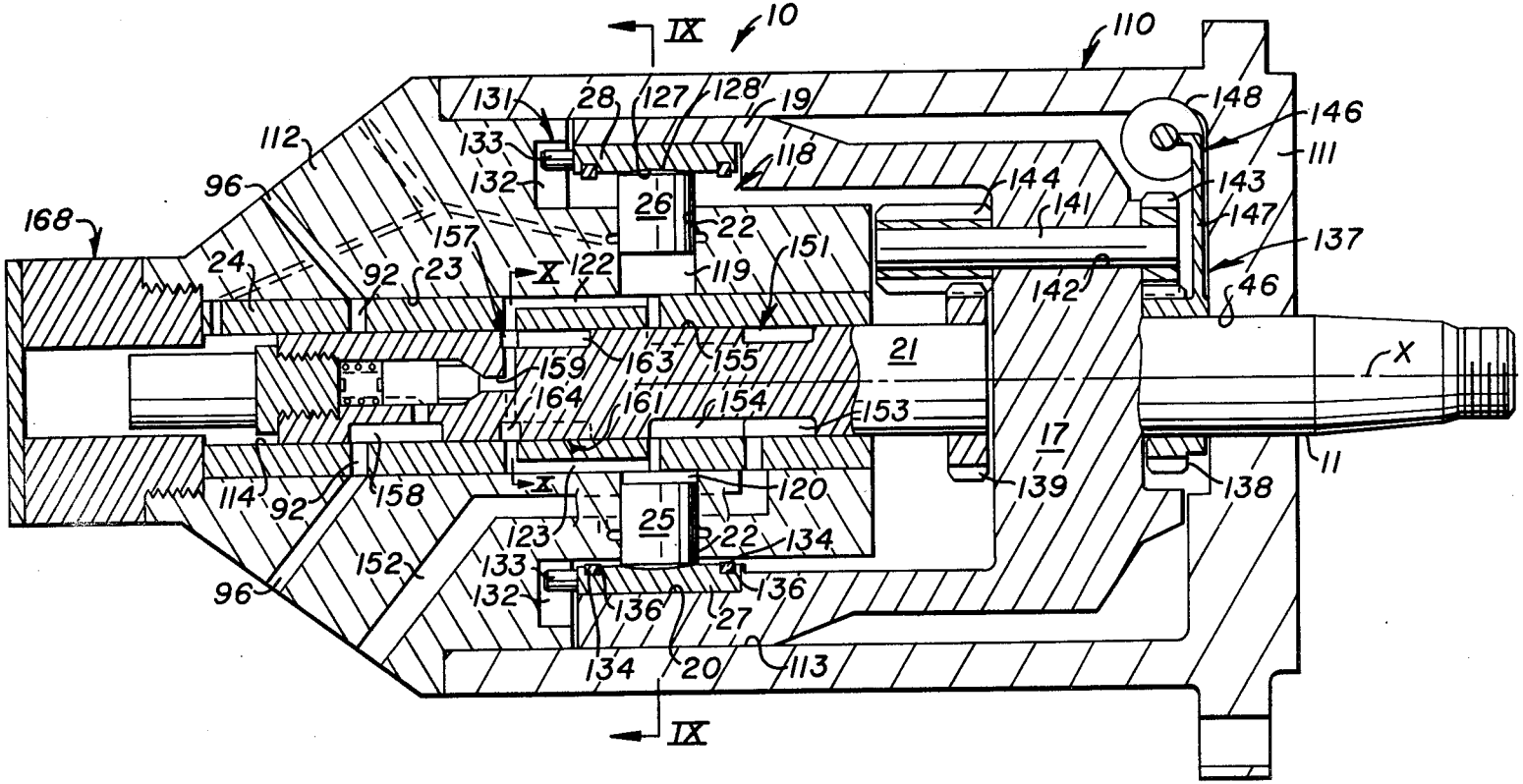
FIG. 8 is a diagrammatic sectional view of a second embodiment of a distributor fuel pump.

A second embodiment of the distributor fuel pump assembly 10 of the present invention is illustrated in FIGS. 8–12. Referring to FIG. 8, a multipart housing 110 has first and second end portions 111 and 112 connected together in the manner as described in conjunction with FIG. 1. Bore 46 extends longitudinally through the first end portion defining a longitudinal axis "X" of the fuel pump assembly. A bore 113 in housing 110 is coaxial with bore 46. A bore 114 extends longitudinally through the sleeve 24 which in turn is positioned in longitudinally extending bore 23 in the second end portion. Each of the outlet ports 96 is in communication with the bore 114 through radial bores 92 in the sleeve.

Figure 9:
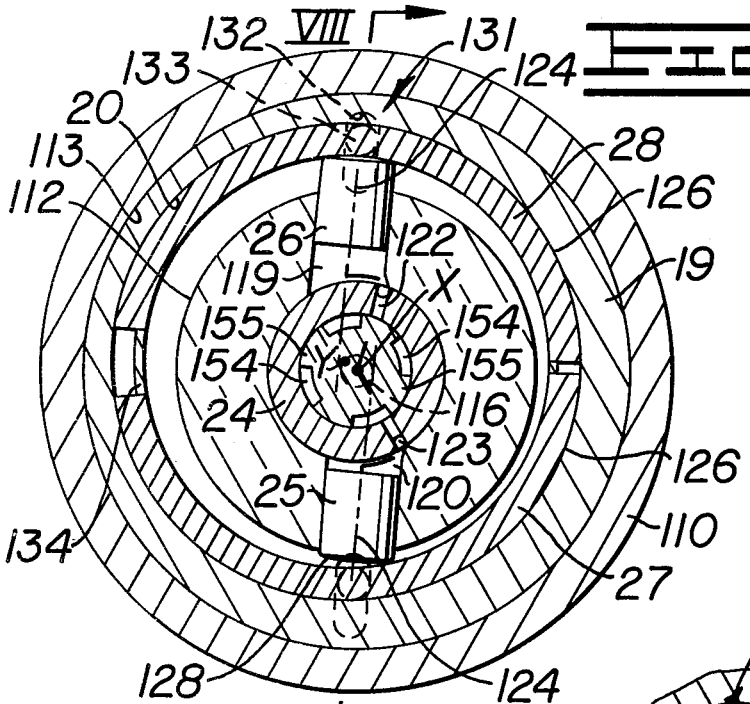
Figure 10:
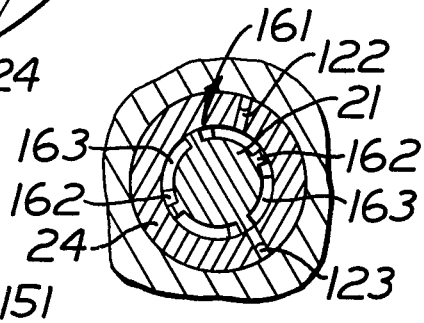
FIG. 10 is a sectional view taken along line X—X of FIG. 8.

The cylindrical extension 19 of the first rotating assembly 17 is journaled for rotation in the bore 113 and shaft 11 rotatably extends outwardly through bore 46 in first end portion 111. The first rotating assembly defines the inner eccentric bore 20 having a centerline "Y" as shown in FIG. 9. Rotation of the first rotating assembly causes the centerline "Y" to orbit around the longitudinal axis "X" in a circular pathway indicated by the broken line 116 and will hereinafter be referred to as the "circle of eccentricity."

The second rotating assembly or metering rotor 21 is rotatably and slidably positioned within the bore 114 in sleeve 24 of the second end portion 112.

Pump means 118 is provided for increasing the pressure of fuel communicated thereto. The pump means can include, for example, bores or cylinders 22 in an extension of the second end portion 112 and pistons 25,26 slidably positioned in the cylinders defining a pair of fluid chambers 119,120 at the inner ends of the pistons. The fluid chambers are in communication with bore 114 in sleeve 24 through a pair of passages 122,123 in the sleeve.

As more clearly shown in FIG. 9, each of the cylinders 22 is angularly offset so that a centerline 124 of the cylinder is substantially tangent to the circle of eccentricity 116 of the inner eccentric bore 20. The centerlines 124 are substantially parallel to one another.

The slipper elements 27,28 of the pump means are positioned between the inner eccentric bore 20 and the outer ends of pistons 25,26. Each of the slipper elements 27,28 is a segment of a ring and has an outer arcuate surface 126 in sliding engagement with the inner eccentric bore 20. A spherical groove 127 is formed in the inner surface of each slipper element. The structural center of spherical groove 127 coincides with the centerline "Y" of the inner eccentric bore 20. A spherical surface 128 is formed on the outer end of each piston and is positioned within the spherical groove. The spherical surface has a radius substantially equal to the radius of the spherical groove.

A means 131 is provided for preventing slipper elements 27,28 from rotating relative to the second end portion 112. The means 131 can be, for example, a pair of slots 132 in the second end portion and a pair of pins 133 connected to the slipper elements and extending therefrom into the slots. Each of the slots is angularly offset similar to the respective cylinder 22 and is positioned in a longitudinally extending plane passing through the centerline 124 of the respective cylinder.

A pair of annular rings 134 are slidably seated in a pair of grooves 136 in the inner surface of each of the slipper elements. The rings 134 hold the slipper elements in sliding contact with the inner eccentric bore 20.

Figure 12:
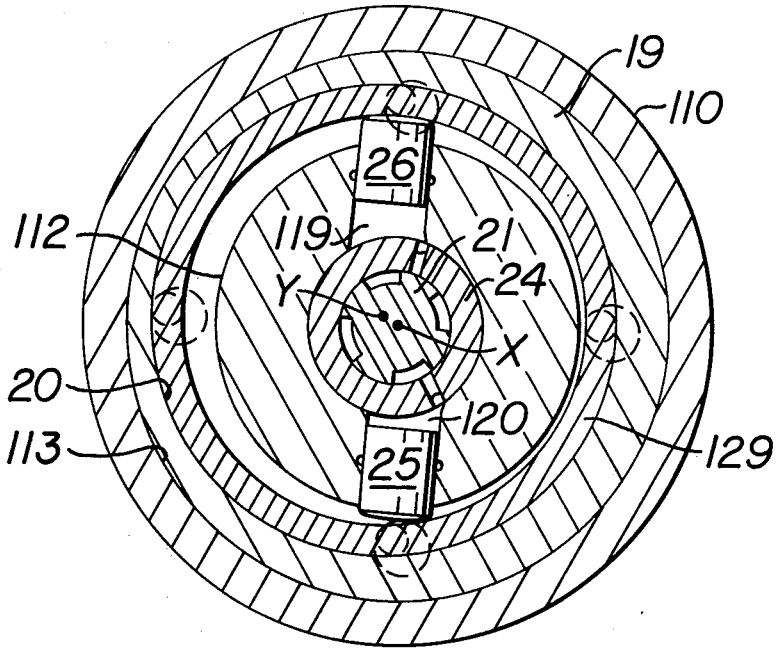
FIG. 12 is an alternate embodiment of the piston and slipper arrangement shown in FIG. 9.

Alternatively, as shown in FIG. 12, the pair of slipper elements which are shown in FIGS. 8 and 9 can be replaced with a single annular slipper element 129 slidably positioned within the eccentric bore 20.

A means 137 is provided for rotating the metering rotor 21 in response to rotation of the first rotating assembly 17 and at a speed proportional to the rotational speed of the first rotating assembly. The means 137 can be, for example, a gear assembly having a first sun gear 138 rotatably positioned on shaft 11 and a second sun gear 139 secured to the metering rotor 21. A shaft 141 rotatably extends through a bore 142 in the first rotating assembly and has first and second spur gears 143,144 secured to the opposite ends thereof. The first spur gear 143 meshes with the first sun gear 138 while the second spur gear 144 meshes with the second sun gear 139. A means 146 for connecting the first sun gear 138 to the housing 110 includes a lever 147 having a first end connected to the first sun gear 138 and means, for example, a solenoid 148 connected to the other end of the lever and to the housing for changing the rotative position of the metering rotor 21 relative to the first rotating element 17 for timing the delivery of fuel to the outlet ports 96.

Figure 11:
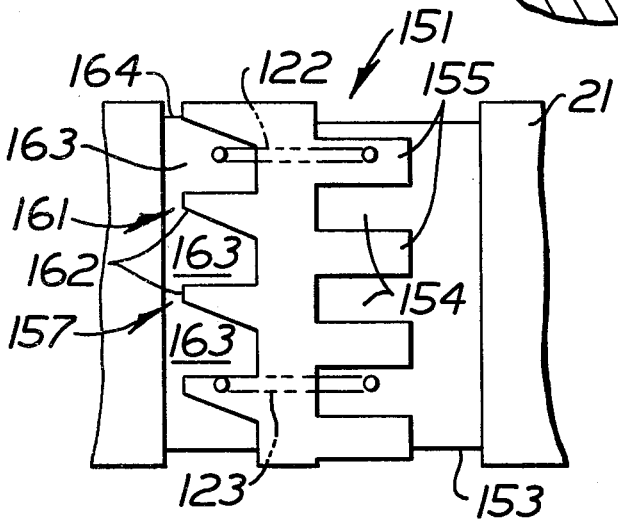
FIG. 11 is a flat development view of an outer surface of a rotor of the fuel pump of FIG. 8.

A means 151 is provided for alternately establishing and blocking communication between a passage 152, which is adapted to be connected to a source of fuel, and the fluid chambers 119,120 in response to rotation of the metering rotor 21. As shown in FIGS. 8, 9, and 11, the means 151 can include an annular groove 153 on the outer surface of metering rotor 21, a plurality of longitudinally extending grooves 154 circumferentially spaced on the outer surface of metering rotor and a plurality of longitudinally extending lands 155 each of which is positioned between adjacent grooves 154. The annular groove 153 is in continuous communication with the passage 152 and the longitudinally extending grooves 154. The lands 155 intermittingly block communication between the passages 122,123 and the grooves 154 in response to rotation of the metering rotor.

A means 157 is provided for periodically directing fluid from fluid chambers 119,120 to each of the outlet ports 96 in a predetermined sequence in response to rotation of metering rotor 21. The second means 157 can be, for example, a longitudinally extending slot 158 in the metering rotor and positioned at a location sufficient for sequentially communicating with outlet ports 96 as the metering rotor rotates. A passageway 159 in the metering rotor is connected to the longitudinal slot. A scroll means 161 is provided on the surface of the metering rotor for directing and metering fuel flow from the passages 122,123 to the passageway 159. As more clearly shown in FIG. 11, scroll means 161 includes a plurality of scrolls 162 with grooves 163 being positioned between each scroll and in communication with an annular groove 164 which is in communication with passageway 159. A delivery valve 166 is positioned in the passageway 159 for permitting fuel flow through the passageway 159 from the annular groove 164 in response to the fuel pressure exceeding a preselected value and blocking fuel flow through the passageway from the slot 158 to the annular groove 164.

A means, for example, a solenoid 168 connected to the metering rotor 21 is provided for moving the metering rotor axially in bore 114 for varying the volumetric flow of fuel directed from the fluid chambers 119,120 to each of the outlet ports 96. Actuation of the solenoid for shifting the metering rotor can be accomplished either manually or automatically in response to engine speed.

Operation of the Second Embodiment

In use, the distributor type fuel pump 10 is driven by shaft 11 interconnected with an engine, not shown, for which fuel is to be provided. Fuel is communicated to the passage 152 from a transfer pump, not shown, also driven by the engine for maintaining a preselected fuel pressure (approximately 30–60 psi) in passage 152. The fuel pump illustrated is for an eight cylinder, four cycle engine and shaft 11 and hence first rotating assembly 17 is driven at twice engine speed. The particular gear assembly illustrated in turn drives the metering rotor 21 at one-half engine speed.

The metering rotor 21 is shown at the fuel shut-off position in FIG. 8. In such position, counterclockwise rotation of first rotating assembly 17 causes reciprocation of pistons 25,26 in their respective cylinders 22. For example, with piston 26 at its extreme outward position and piston 25 at its extreme inward position, counterclockwise rotation of shaft 11 will, by virtue of the inner eccentric bore 20, force the slipper element 28 generally inwardly toward the longitudinal axis, thereby pushing piston 26 inwardly. At the same time, metering rotor 21 is also being rotated counterclockwise so that one of the lands 155 moves to a position to block communication of fuel to passage 122. (As viewed in FIG. 11, the lands 155 move upwardly relative to the passages 122,123). The fuel in fluid chamber 119 is thus forced to flow through the passage 122, annular groove 164, passage 123, and into fluid chamber 120 where it will act in conjunction with the supply fuel pressure from passage 152 to push piston 25 outwardly to cause it to essentially remain in contact with slipper element 27 which is being moved radially outwardly by annular rings 34. With annular groove 164 being in communication with passage 123, no fuel will be delivered through the outlet ports 96.

Now assume that metering rotor 21 is moved to the left relative to the passages 122,123, such position being illustrated in FIG. 11. As piston 26 moves inwardly from its extreme outward position, fuel in fluid chamber 119 is displaced. Shortly after the piston starts to move inwardly, one of the lands 155 moves to a position to block communication between passage 122 and longitudinal grooves 154 so that fuel forced from the fluid chamber 119 flows through passage 122, one of the longitudinal grooves 163, annular groove 64, and into passageway 159. During the initial movement of piston 26, delivery valve 166 prevents flow of fuel through passageway 159 and the fuel will flow through passage 123 and into fluid chamber 120. After continued rotation of metering rotor 21, one of the scrolls 162 moves to a position to block passageway 123 from communication with longitudinal grooves 163 and annular groove 164. At this time, the fuel pressure in fluid chamber 119 and the passages connected thereto rapidly increases and the fuel passes through the delivery valve 166, slot 158, and one of the outlet ports 96. Continued rotation of the metering rotor 21 causes the scroll to uncover the passage 123 and the remainder of the fuel from fluid chamber 119 passes into fluid chamber 120.

During the time that passage 123 is blocked by one of the scrolls 162, fuel from passage 152 passes through the annular groove 163 and one of the longitudinal grooves 154, passage 123, and into fluid chamber 120.

When piston 26 reaches the extreme inward position and piston 25 reaches the extreme outward position, piston 25 then becomes the pumping piston.

Since the trailing edges of scrolls 162 are tapered such that the scrolls increase in width toward the right, changes in the axial position of metering rotor 21 changes the volumetric flow of fuel delivered through outlet ports 96 from zero to the maximum as designed for the fuel pump. The axial position of the metering rotor can be suitably controlled in the usual manner for both manual and automatic (governed) control of engine speed.

Timing of the delivery of fuel from outlet port 96 and hence the injection of fuel to the combustion chambers is achieved by rotation of the sun gear 38 relative to housing 110. This changes the rotative position of the metering rotor 21 relative to the first rotating assembly 17 and hence the angular position at which the scroll blocks passage 123. In this embodiment, control of the position of sun gear 138 is through the solenoid 148 suitably connected to electronic controls in the usual manner.

The angular offset of the centerline 124 of cylinders 22 results in very even bearing of the spherical surfaces 128 of the pistons 25,26 against the spherical grooves 127 in the slipper elements, particularly throughout the pumping period of the piston. This results in a quite low contact or Hertz stress between the piston and slipper element. Although considerable mismatch of the spherical surface 128 of the pistons 25,26 and the spherical grooves 127 occurs at other times during the inward and outward stroke of the piston, this is unimportant since the force between the pistons and slipper element is very low at such times.

The angular offset of the centerline 124 of cylinder 22 also results in low side forces between the pistons 25,26 and the cylinder 22.

Other aspects, objects, and advantages of this invention can be obtained from a study of the drawings, the disclosure, and the appended claims.

The embodiments of the invention in which an exclusive property or privilege is claimed are defined as follows:

1. A distributor fuel pump assembly for an engine comprising:

a housing having a first end portion, a second end portion, a first bore extending longitudinally through said first end portion defining a longitudinal axis a second bore extending through said second end portion, a third bore in one of said first and second end portions coaxial with said first bore, and a plurality of outlet ports and inlet passage means in communication with said second bore;

a first rotating assembly journaled for rotation in said third bore and having a shaft rotatably extending outwardly through said first bore and an inner eccentric bore proximate said second end portion;

a second rotating assembly rotatably and slidably positioned in said second bore;

pump means in said second end portion for increasing the pressure of fuel communicated thereto, said pump means including a bore in said second end portion, a piston slidably positioned in said bore defining a fluid chamber at an inner end of said piston, and a slipper element positioned between said piston and said inner eccentric bore;

a gear assembly drivingly interconnecting said first and second rotating assemblies for rotating said second rotating assembly in response to rotation of said first rotating assembly and at a speed proportional to the rotational speed of said first rotating assembly;

first means for alternately establishing and blocking communication between said inlet passage means and said fluid chamber in response to rotation of said second rotating assembly;

second means for periodically directing fluid from said fluid chamber to each of said outlet ports in a predetermined sequence in response to rotation of said second rotating assembly; and third means for moving said second rotating assembly axially in said second bore for varying the volumetric flow of fuel directed from said fluid chamber to each of said ports.

2. The fuel pump assembly of claim 1 wherein said bore of said pump means extends radially outwardly and is substantially perpendicular to said longitudinal axis.

3. A distributor fuel pump assembly for an engine comprising:

a housing having a first end portion, a second end portion, a first bore extending longitudinally through said first end portion defining a longitudinal axis, a second bore extending through said second end portion, a third bore in one of said first and second end portions coaxial with said first bore, and a plurality of outlet ports and inlet passage means in communication with said second bore;

a first rotating assembly journaled for rotation in said said third bore and having a shaft rotatably extending outwardly through said first bore and an inner eccentric bore proximate said second end portion;

a second rotating assembly rotatably and slidably positioned in said second bore;

pump means in said second end portion for increasing the pressure of fuel communicated thereto, said pump means including a bore in said second end portion, a piston slidably positioned in said bore defining a fluid chamber at an inner end of said piston, and a slipper element positioned between said piston and said inner eccentric bore;

first means for rotating said second rotating assembly in response to rotation of said first rotating assembly and at a speed proportional to the rotational speed of said first rotating assembly;

second means for alternately establishing and blocking communication between said inlet passage means and said fluid chamber in response to rotation of said second rotating assembly;

third means for periodically directing fluid from said fluid chamber to each of said outlet ports in a predetermined sequence in response to rotation of said second rotating assembly;

fourth means for moving said second rotating assembly axially in said second bore for varying the volumetric flow of fuel directed from said fluid chamber to each of said ports; and wherein said inner eccentric bore has a circle of eccentricity defined by the center line of the eccentric bore orbiting around said longitudinal axis in response to rotation of said first rotating assembly and said bore of said pump means has a centerline angularly offset, said centerline being substantially tangent to the circle of eccentricity of the inner eccentric bore of the first rotating assembly.

4. The fuel pump assembly of claim 3 wherein said slipper element has an outer arcuate surface, an inner surface, and a spherical groove in said inner surface, said outer arcuate surface being in sliding engagement with said inner eccentric bore, said spherical groove having a center coincidental with the axis of said inner eccentric bore, said piston having a spherical surface on its outer end, said spherical surface being seated in said spherical groove and having a radius substantially equal to the radius of said spherical groove.

5. A distributor fuel pump assembly for an engine comprising:

a housing having a first end portion, a second end portion, a first bore extending longitudinally through said first end portion defining a longitudinal axis, a second bore extending through said second end portion, a third bore in one of said first and second end portions coaxial with said first bore, and a plurality of outlet ports and inlet passage means in communication with said second bore;

a first rotating assembly journaled for rotation in said third bore and having a shaft rotatably extending outwardly through said first bore and an inner eccentric bore proximate said second end portion;

a second rotating assembly rotatably and slidably positioned in said second bore;

pump means in said second end portion for increasing the pressure of fuel communicated thereto, said pump means including a bore in said second end portion, a piston slidably positioned in said bore defining a fluid chamber at an inner end of said piston, and a slipper element positioned between said piston and said inner eccentric bore;

first means for rotating said second rotating assembly in response to rotation of said first rotating assembly and a speed proportional to the rotational speed of said first rotating assembly;

second means for alternately establishing and blocking communication between said inlet passage means and said fluid chamber in response to rotation of said second rotating assembly;

third means for periodically directing fluid from said fluid chamber to each of said outlet ports in a predetermined sequence in response to rotation of said second rotating assembly;

fourth means for moving said second rotating assembly axially in said second bore for varying the volumetric flow of fuel directed from said fluid chamber to each of said ports; and wherein said slipper element is an annular ring.

6. The fuel pump assembly of claim 5 including means for preventing said slipper element for rotating relative to said second end portion.

7. A distributor fuel pump assembly for an engine comprising:

a housing having a first end portion, a second end portion, a first bore extending longitudinally through said first end portion defining a longitudinal axis, a second bore extending through said second end portion, a third bore in one of said first and second end portions coaxial with said first bore, and a plurality of outlet ports and inlet passage means in communication with said second bore;

a first rotating assembly journaled for rotation in said third bore and having a shaft rotatably extending outwardly through said first bore and an inner eccentric bore proximate said second end portion;

a second rotating assembly rotatably and slidably positioned in said second bore;

pump means in said second end portion for increasing the pressure of fuel communicated thereto, said pump means including a bore in said second end portion, a piston slidably positioned in said bore defining a fluid chamber at an inner end of said piston, and a slipper element having an inner surface positioned between said piston and said inner eccentric bore;

first means for rotating said second rotating assembly in response to rotation of said first rotating assembly and at a speed proportional to the rotational speed of said first rotating assembly;

second means for alternately establishing and blocking communication between said inlet passage means and said fluid chamber in response to rotation of said second rotating assembly;

third means for periodically directing fluid from said fluid chamber to each of said outlet ports in a predetermined sequence in response to rotation of said second rotating assembly;

fourth means for moving said second rotating assembly axially in said second bore for varying the volumetric flow of fuel directed from said fluid chamber to each of said ports; and means for maintaining said slipper element in sliding contact with said inner eccentric bore, said maintaining means including an arcuate groove in the inner surface of said slipper element and an annular ring slidably positioned within said groove.

8. A distributor fuel pump assembly for an engine comprising:

a housing having a first end portion, a second end portion, a first bore extending longitudinally through said first end portion defining a longitudinal axis, a second bore extending through said second end portion, a third bore in one of said first and second end portions coaxial with said first bore, and a plurality of outlet ports and inlet passage means in communication with said second bore;

a first rotating assembly journaled for rotation in said third bore and having a shaft rotatably extending outwardly through said first bore and an inner eccentric bore proximate said second end portion;

a second rotating assembly rotatably and slidably positioned in said second bore;

pump means in said second end portion for increasing the pressure of fuel communicated thereto, said pump means including a pair of bores in said second end portion, a pair of pistons slidably positioned in said bores defining a fluid chamber at an inner end of each of said pistons, and a pair of slipper elements positioned between said pistons and said inner eccentric bore;

first means for rotating said second rotating assembly in response to rotation of said first rotating assembly and at a speed proportional to the rotational speed of said first rotating assembly;

second means for alternatively establishing and blocking communication between said inlet passage meaans and said fluid chambers in response to rotation of said second rotating assembly;

third means for periodically directing fluid from said fluid chambers to each of said outlet ports in a predetermined sequence in response to rotation of said second rotating assembly;

fourth means for moving said second rotating assembly axially in said second bore for varying the volumetric flow of fuel directed from said fluid chambers to each of said ports; and wherein said inner eccentric bore has a circle of eccentricity defined by the centerline of the eccentric bore orbiting around said longitudinal axis in response to rotation of said first rotating assembly, and each of said bores of said pump means has a centerline angularly offset, said centerline being substantially tangent to the circle of eccentricity of the inner eccentric bore of the first rotating element, said slipper elements each having an outer arcuate surface in sliding engagement with said inner eccentric bore, an inner surface, a spherical groove in said inner surface concentric with the inner eccentric bore, each of said pistons having a spherical surface on its outer end, said spherical surface being seated in said spherical groove and having a radius substantially equal to the radius of said spherical groove.

9. The fuel pump assembly of claim 8 including means for preventing said slipper elements from rotating relative to said second end portion.

10. The fuel pump assembly of claim 9 wherein said means for preventing said slipper elements from rotation includes a slot in the second end portion and a pin connected to the slipper element and extending outwardly therefrom into said slot.

11. The fuel pump assembly of claim 10 wherein said slot is parallel to the centerline of the respective bore of said pump means.

12. The fuel pump assembly of claim 1 wherein said gear assembly includes a planetary gear assembly having a first ring gear connected to said housing, a planetary cluster having first and second gears and being rotatably connected to said first rotating assembly, said first gear being in mesh with said first ring gear, and a second ring gear connected to said second rotating element and being in mesh with said second gear of said planetary cluster.

13. The fuel pump assembly of claim 12 including means for changing the rotative position of the second rotating assembly relative to said first rotating assembly for adjusting the timing of the delivery of fuel directed through said outlet ports.

14. The fuel pump assembly of claim 13 wherein said means for changing the rotative position of the second rotating assembly includes means for changing the position of the first ring gear relative to said housing.

15. The fuel pump assembly of claim 12 including means responsive to engine speed for changing the rotative position of the second rotating assembly relative to said first rotating assembly for adjusting the timing of the delivery of fuel directed through said outlet ports.

16. The fuel pump assembly of claim 15 wherein the means responsive to engine speed for changing the rotative position of the second rotating assembly includes a source of pressurized fuel, a transverse passage in said shaft of said first rotating assembly forming a cylinder, shuttle piston means mounted in said cylinder for transvere reciprocation therein, fuel from the source of fuel to the transverse passage, transverse cylinder means defined in said first end portion proximate the periphery thereof and radially spaced outwardly from said first ring gear, a piston mounted in said transverse cylinder means for reciprocation therein, said piston defining an outwardly extended tang, said first ring gear defining a socket for receiving said tang, and orifice passage means extending from said first bore for communicating fuel periodically from the shuttle piston means to the transverse piston.

17. The fuel pump assembly of claim 1 wherein said gear assembly includes a first sun gear rotatably positioned on said shaft, means for connecting the first sun gear to the housing, a second sun gear secured to said second rotating assembly, a shaft rotatably carried by said first rotating assembly and having first and second spur gears secured to the opposite ends thereof, said first spur gear being in mesh with the first sun gear, and said second spur gear being in mesh with the second sun gear.

18. The fuel pump assembly of claim 17 wherein said means for connecting the first sun gear to the housing includes a lever having a first end connected to the first sun gear and means connected to the other end of the lever for changing the rotative position of the second rotating assembly relative to said first rotating assembly for adjusting the timing of delivery of fuel directed through said outlet ports.

19. The fuel pump assembly of claim 1 including a first passage connecting the fluid chamber with the first and second means, said first means including an annular groove on the outer surface of said second rotating assembly in communication with said inlet passage means, a plurality of longitudinally extending grooves circumferentially spaced on the outer surface of said second rotating assembly, and a plurality of longitudinally extending lands each being positioned between adjacent longitudinally extending grooves, said longitudinally extending grooves being in continuous communication with said annular groove.

20. The fuel pump assembly of claim 19 wherein said second means includes a longitudinally extending slot on the outer surface of said second rotating assembly and positioned at a location sufficient for sequentially communicating with the outlet ports, a second passage in said second rotating assembly connected to said longitudinally extending slot, and scroll means on the outer surface of said second rotating assembly for directing and metering fuel flow from said first passage to said second passage.

21. The fuel pump assembly of claim 1 wherein said third means includes a governor means for moving the second rotative assembly axially in said second bore in response to changes in engine speed.

22. The fuel pump assembly of claim 21 wherein said governor means includes flyweight means driven by said gear assembly and responsive to engine speed for urging the second rotating assembly in a first direction for decreasing the volumetric output of fuel and resilient means for urging the second rotating assembly in a second direction for increasing the volumetric flow of fuel directed to each of said ports.

23. The fuel pump assembly of claim 1 including means for resiliently urging the piston outwardly.

24. The fuel pump assembly of claim 1 including a gear pump means disposed in said first end portion and driven by said shaft for delivering fuel to said first means.

25. A distributor fuel pump assembly for an engine comprising:

a housing having a bore defining a longitudinal axis, and a plurality of outlet ports and inlet passage means in communication with said bore;

a metering rotor rotatably and slidably positioned within said bore;

a rotating assembly rotatable relative to said housing and having an eccentric bore, said eccentric bore having a circle of eccentricity defined by the centerline of the eccentric bore orbiting around said longitudinal axis in response to rotation of said rotating assembly;

a second bore in said housing and having a centerline angularly offset and being substantially tangent to said circle of eccentricity;

a piston slidably positioned in said second bore defining a fluid chamber at an inner end of said piston;

a slipper element positioned between said piston and said eccentric bore;

first means for rotating said metering rotor in response to rotation of said rotating assembly and at a speed proportional to the rotational speed of said rotating assembly;

second means for alternately establishing and blocking communication between said inlet passage means and said fluid chamber in response to rotation of said metering rotor;

third means for periodically directing fluid from said fluid chamber to each of said outlet ports in a predetermined sequence in response to rotation of said rotating assembly; and fourth means for moving said metering rotor axially in said bore for varying the volumetric flow of fuel directed ffrom said fluid chamber to each of said outlet ports.

26. The fuel pump assembly of claim 25 including another bore in said housing and having a centerline angularly offset and being substantially tangent to said circle of eccentricity, a second piston slidably positioned in said other bore defining another fluid chamber at an inner end of said second piston, a second slipper element positioned between said second piston and said eccentric bore, each of said slipper elements having an outer arcuate surface in sliding engagement with said eccentric bore, an inner surface, and a spherical groove in said inner surface concentric with the eccentric bore, each of said pistons having a spherical surface on its outer end, said spherical surface being seated in said spherical groove and having a radius substantially equal to the radius of said spherical groove.

* * * * *